United States Patent [19]

Christensen

[11] 4,164,834

[45] Aug. 21, 1979

[54] JUNIOR STIRRUPS ATTACHMENT FOR ADULT-SIZE SADDLE

[76] Inventor: George L. Christensen, 624 N. 1st West, Tremonton, Utah 84337

[21] Appl. No.: 729,188

[22] Filed: Oct. 4, 1976

[51] Int. Cl.[2] ..... B68C 1/16

[52] U.S. Cl. ..... 54/46

[58] Field of Search ..... 54/44, 46, 47, 48, 49

[56] References Cited

U.S. PATENT DOCUMENTS

| | | | |
|---|---|---|---|
| 320,194 | 6/1885 | Turner | 54/47 |
| 662,564 | 11/1900 | Hicks | 54/44 |
| 862,572 | 8/1907 | Maussner | 54/46 |
| 1,069,822 | 8/1913 | Sievert | 54/44 |
| 1,214,364 | 1/1917 | Peterson | 54/46 |
| 2,482,153 | 9/1949 | Cavin | 54/46 |
| 3,112,592 | 12/1963 | Schindler | 54/44 |
| 3,196,595 | 7/1965 | McKeen, Jr. | 54/46 |
| 3,234,710 | 2/1966 | Gauthier | 54/44 |
| 3,234,711 | 2/1966 | Jamieson | 54/46 |
| 3,916,604 | 11/1975 | Phipps | 54/44 |

*Primary Examiner*—Richard T. Stouffer
*Attorney, Agent, or Firm*—Edward E. McCullough

[57] ABSTRACT

A flexible, main strap has a stirrup attached to each end, a forward-extending loop fixed to the center of the main strap, and a small, forward-extending strap also fixed to the main strap. The loop is passed through the typical opening under the pommel of a saddle and looped over the saddle horn. The loop is retained on the saddle horn by the small strap, passed through the loop and fastened into a second loop by a buckle.

An alternate embodiment of the invention eliminates the central loop and small strap, and replaces them with two, forwardly-extending, small straps attached to the main strap so that each may be passed under the pommel of the saddle, through the opening, and buckled to itself to form a loop around each side of the pommel. Alternatively, these straps may be attached to fixtures on the saddle. This arrangement is useful for saddles having no openings under the pommel.

4 Claims, 4 Drawing Figures

JUNIOR STIRRUPS ATTACHMENT FOR ADULT-SIZE SADDLE

BACKGROUND OF THE INVENTION

This invention relates broadly to saddles for horses. More specifically, it relates to sets of stirrups, for small children, that are attachable to horse saddles.

The present invention fills a need for adapting an adult-size saddle for use by children, without the necessity of exchanging the saddle, itself, for one of a smaller size. It also fills a need for a training device whereby a small child may safely become accustomed to riding horses while being accompanied and protected by an adult.

SUMMARY OF THE INVENTION

This invention includes a wide, flexible, main strap, each end of which is attached to a stirrup by a loop. The portion of each loop that is adjacent the horse, when the main strap is draped over the saddle, has a 180° twist that orients each stirrup to receive the child's foot by a forward thrust thereof. The main strap is attachable to the saddle by a loop, fixed to a central edge of the main strap, that may be passed under the pommel of the saddle and over the saddle horn. It is retained on the saddle horn by a small strap, fixed at one end to the main strap, that is passed through the loop on the saddle horn and fastened into the form of a second loop by a buckle.

In a second embodiment, the loop and small strap are eliminated and replaced by two small straps, each fastened at one end to the central portion of the main strap. They are used for attaching the main strap to the saddle by being passed through the opening under the pommel, and each being looped over its respective side of the pommel, and fastened into the form of a loop by a buckle.

Objects of the invention are to provide a safe and effective, junior stirrups for attachment to an adult-size saddle; so that child riders may use an adult-size saddle in comfort without having to use a smaller-size saddle. Another object of the invention is to provide means of introducing a child to horse back riding with the security of adult presence on the horse. Other objects and advantages of the invention will become apparent as the following detailed description is read with reference to the accompanying drawings, wherein the same parts are designated with the same numbers throughout the disclosure.

DESCRIPTION OF THE PREFERRED EMBODIMENTS

Figure 1:
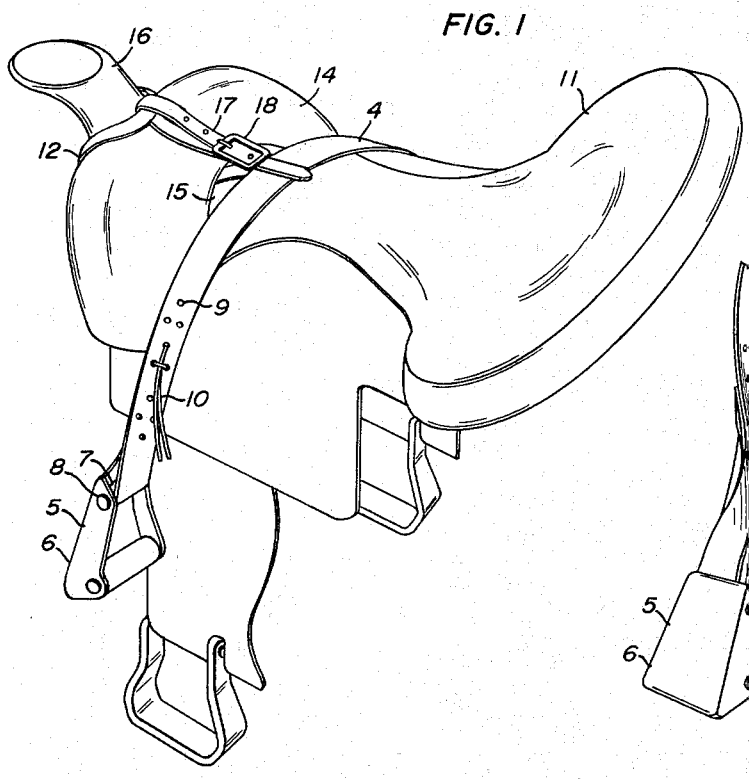
FIG. 1 is a perspective view of the invention.
Figure 2:
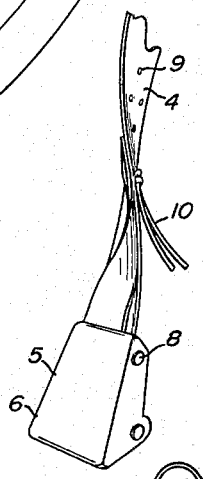
FIG. 2 is a perspective detail of the stirrup, rotated 180°.
Figure 3:
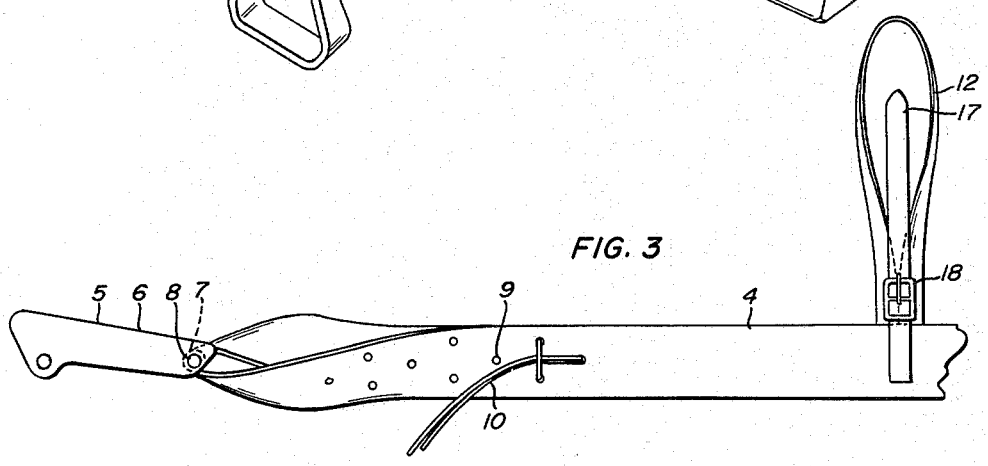
FIG. 3 is a flat view of the left-hand and central portion of the attachment of the invention.

A wide, flexible, main strap 4, preferably of leather, has a stirrup 5 attached to each end thereof. The preferred stirrup 5 is equipped with a conventional hood 6. However, this is optional equipment, and is not essential to the invention. A typical stirrup 5 is closed at its upper portion by a bolt or roller 7 equipped with a threaded nut 8, or equivalent fastening means. A preferred means of attaching a stirrup 5 to the strap 4 is by looping each end of the strap 4 around the bolt 7 and fastening the strap 4 to itself. In this embodiment, the strap 4 has a series of perforations 9 in each end portion thereof; so that the loop around each bolt 7 is formed by doubling the strap 4 upon itself and fastening it with a lace 10 that is passed through the desired set of perforations 9 and tied. Before each of the loops is fastened in this manner, however, the portion thereof that is adjacent the horse is twisted 180° to orient the stirrup to receive the child rider's foot by a simple forward thrust thereof.

The lace 10 may be permanently fastened to each end of the strap 4 for convenience. Although the lace 10 is preferably a leather thong, it may be any suitable form of lace or cord. Also, it may be of any commonly used material, such as Nylon or cotton. By selecting the desired set of perforations 9, by which each end portion of the strap 4 is attached to itself, the height of the stirrups 5 relative to the saddle 11 (see FIG. 1) may be adjusted.

In this preferred embodiment, a loop 12 is attached to the central portion of one edge of the strap 4. As shown in FIG. 1, the loop 12 is used to fasten the strap 4 to a saddle 11 by passing it under the pommel 14, through the opening 15, and over the saddle horn 16. The loop 12 is firmly retained on the saddle horn 16 by a small strap 17 that is attached at one end to the central portion of the main strap 4. The small strap 17 is passed under the loop 12 at the saddle horn 16, and is passed back upon itself to form a loop retained by a buckle 18 that is preferably fixed to the main strap 4.

Figure 4:
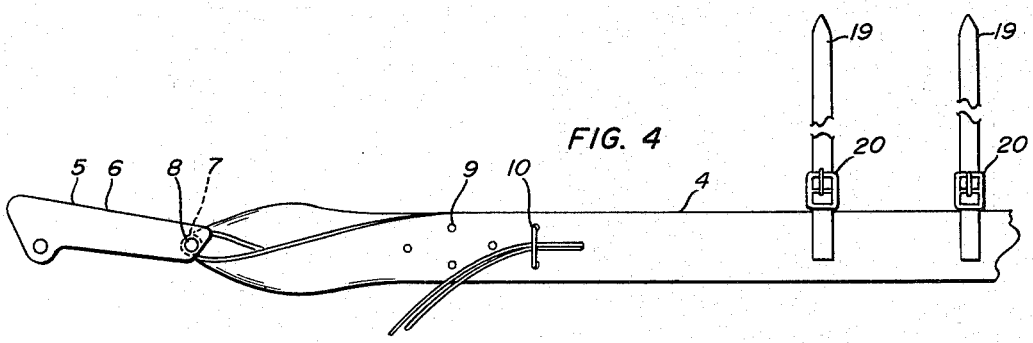
FIG. 4 is similar to FIG. 3, showing an alternate embodiment of the invention.

An alternate embodiment of the invention is shown in FIG. 4, wherein the loop 12 and small strap 17 are eliminated and replaced by a pair of small straps 19 that are each fixed at one end to one edge of the main strap 4. In this embodiment, each strap 19 is passed under the pommel 14, through the opening 15, looped around one side of the pommel 14, and fastened into the form of a loop by a buckle 20 that is fixed to the main strap 4. These small straps 19 could be laces, cords, or thongs, and could be fastened to themselves simply by being tied. Alternatively, they may engage some fixtures, such as eyelets, with which saddles are commonly equipped. Also, they may engage the saddle by being passed around the pommel from each side and tied together.

An invention has been described that provides an advance in the art. Although it has been presented specifically with regard to details, it should be noted that many details may be altered without departing from the scope of the invention, as it is defined in the following claims.

The invention claimed is:

1. A junior stirrups attachment for an adult-size, stirrups-equipped, horse saddle, comprising:

a flexible main strap having the general form of a thin, flat, elongated rectangle;

a junior-size stirrup attached to each end portion of the main strap with a loop formed by doubling the end portion of the main strap upon itself to include the bolt of the stirrup within the loop and closing the loop by a fastening means; and means for fastening the main strap to the forward portion of an adult-size saddle so that the main strap lies across the adult-size saddle at right angles thereto, with equal end portions of the main strap suspended from the saddle on either side thereof, whereby a child rider can sit on the seat of the adult-size saddle, together with an accompanying adult, and the need for a special, piggyback, junior-size, saddle seat is eliminated, said fastening means comprising a first loop formed by an elongated piece of strong, flexible material attached at each of its ends to the forward edge of the central portion of the main strap, a second strap fixed at one end to the same edge of the central portion of the main strap, and fastening means fixed adjacent the juncture of the second strap with the main strap so that the second strap can be fastened thereby into the form of a second loop, the first loop being capable of fastening the main strap to the adult-size saddle by being passed through an opening under the pommel and over the saddle horn thereof, the first loop being capable of being secured to the saddle horn by the second strap being passed through the first loop and then being fastened by the fastening means adjacent the juncture of the second strap with the main strap to form a loop.

2. The attachment of claim 1 wherein the fastening means for fastening the second strap into the form of a loop is a buckle fixed to the second strap.

3. The attachment of claim 1 wherein the main strap has a plurality of perforations for engagement by fastening means, so that the loops of the strap are adjustable; and wherein the fastening means for each end of the strap is a lace that fastens the end of the strap into a loop by being passed through appropriate perforations therein and knotted.

4. The attachment of claim 3 wherein each of said loops, that fastens the stirrups to the main strap, has a 180° twist that positions the stirrup into alignment with the rider's foot for easy insertion thereof.

* * * * *